US010287778B2

(12) United States Patent
Simões Vicente

(10) Patent No.: US 10,287,778 B2
(45) Date of Patent: May 14, 2019

(54) SYSTEM FOR CONNECTION AND FITTING METHOD BETWEEN MODULES FOR FLOOR COVERINGS

(71) Applicant: Nuno Miguel Simões Vicente, Sintra (PT)

(72) Inventor: Nuno Miguel Simões Vicente, Sintra (PT)

( * ) Notice: Subject to any disclaimer, the term of this patent is extended or adjusted under 35 U.S.C. 154(b) by 0 days.

(21) Appl. No.: 15/747,701

(22) PCT Filed: Jul. 29, 2016

(86) PCT No.: PCT/PT2016/050019

§ 371 (c)(1),
(2) Date: Jan. 25, 2018

(87) PCT Pub. No.: WO2017/018900

PCT Pub. Date: Feb. 2, 2017

(65) Prior Publication Data

US 2018/0223539 A1 Aug. 9, 2018

(30) Foreign Application Priority Data

Jul. 29, 2015 (PT) ..... 108736

(51) Int. Cl.
*E04B 2/00* (2006.01)
*E04F 15/02* (2006.01)

(52) U.S. Cl.
CPC ..... *E04F 15/02038* (2013.01); *E04F 2201/0123* (2013.01); *E04F 2201/0138* (2013.01); *E04F 2201/049* (2013.01)

(58) Field of Classification Search
CPC ..... E04F 15/02038; E04F 2201/0123; E04F 2201/049; E04F 2201/0138
(Continued)

(56) References Cited

U.S. PATENT DOCUMENTS 357,144 A * 2/1887 Buttler ..... E04F 15/04 52/592.2
757,812 A * 4/1904 Keyes ..... E04B 1/2604 144/354
(Continued)

FOREIGN PATENT DOCUMENTS

EP 2010733 A1 1/2009
FR 2917761 A1 12/2008
(Continued)

OTHER PUBLICATIONS

International Search Report for PCT/PT2016/050019 dated Oct. 20, 2016 and its English translation provided by WIPO.
(Continued)

*Primary Examiner* — Basil S Katcheves
(74) *Attorney, Agent, or Firm* — Ladas & Parry, LLP

(57) ABSTRACT

The present invention relates to a system for connecting and a fitting method between modules for floor covering. The system comprises a female element (1) and a male element (2) connected to the floor modules and interlinked. The female element (1) consists of a major plate of the female element (1.1), track (1.2), edge (1.3), notches (1.3.1) (1.3.2), superior plate of the female element (1.4) and a groove (1.5). The male element (2) consists of a major plate of the male element (2.1), inferior plate (2.2), two protrusions, minor plate of the male element (2.3) and a latch (2.3.1).

8 Claims, 7 Drawing Sheets

(58) Field of Classification Search
USPC ..... 52/588.1
See application file for complete search history.

(56) References Cited

U.S. PATENT DOCUMENTS 3,657,852 A * 4/1972 Worthington ..... E04F 15/02 52/392
3,667,153 A * 6/1972 Christiansen ..... A63H 33/062 446/124
5,014,488 A * 5/1991 Evangelos ..... E04F 13/0862 52/220.3
D425,575 S * 5/2000 Cyrus ..... D21/484
6,751,912 B2 * 6/2004 Stegner ..... E01C 5/20 52/177
6,802,159 B1 * 10/2004 Kotler ..... E01C 5/20 404/35
8,266,849 B2 * 9/2012 Bravo ..... E04F 15/105 52/177
8,316,606 B2 * 11/2012 Siewert ..... E04F 13/10 52/483.1
8,726,603 B2 * 5/2014 Huang ..... E04F 15/02 52/591.1
8,939,674 B2 * 1/2015 Zimmer ..... A63H 33/062 403/14
2003/0180091 A1 9/2003 Stridsman
2005/0028475 A1 * 2/2005 Barlow ..... A63B 67/02 52/578
2006/0254182 A1 * 11/2006 Cerasi ..... E04F 15/02 52/592.1
2007/0094979 A1 * 5/2007 Richardson ..... E04B 1/34321 52/578
2009/0249732 A1 10/2009 Bly
2011/0289875 A1 12/2011 Lenoci

FOREIGN PATENT DOCUMENTS

WO 2001098604 A1 12/2001
WO 2006113228 A2 10/2006
WO 2010079462 A1 7/2010

OTHER PUBLICATIONS

Written Opinion of the International Search Authority for PCT/PT2016/050019 dated Oct. 20, 2016 and its English translation provided by Google Translate.

* cited by examiner

SYSTEM FOR CONNECTION AND FITTING METHOD BETWEEN MODULES FOR FLOOR COVERINGS

CROSS-REFERENCE TO RELATED APPLICATION

The present application is the U.S. National Phase of PCT Application PCT/PT2016/050019 filed on Jul. 29, 2016 which claims the priority of Portuguese Patent Application No. 108736 filed on Jul. 29, 2015, the disclosures of which are incorporated herein by reference.

FIELD OF THE INVENTION

The present invention generally relates to the use of modular indoor or outdoor floorings, more specifically to a system for connecting and method of fitting together the modules that constitute the floor covering by means of male and female elements, which are not part of the modules and that are coupled to them.

BACKGROUND OF THE INVENTION

Modular systems for floor coverings have been well known since long. There is a huge variety of documents that refer to them, whether coverings made of natural materials such as wood or cork or made of synthetic or artificial materials.

The most classical method for fixing the modules to the floor consists of placing an aggregate material immediately above the floor upon which the covering is to be placed. This method has several disadvantages, being one of them the fact that the modules are easily damaged as upon fixing, any expansion or shrinkage which is common in any material, will cause the appearance of cracks and deformations. Therefore, the need for replacement of the modules becomes more pressing, which is also made difficult by the fact that the modules are fixed to the floor.

In response to this problem, coverings in which the modules fit together by means of solutions involving a male member and a female member have begun to emerge. Several documents relating to this solution may be mentioned, for example, WO2001098604 document disclosing a "floor covering with coupling means" or FR2917761 document disclosing a "Removable floor, for example, for a dance hall, with connections and cooperating interlocking units with each adjacent modular element", or still the EP2010733 document that mentions a "Connection system for a mobile floor".

Additionally, document WO2006113228 "Sub-flooring assembly and method" refers to an assembly comprised of sections that include male elements and female elements at the ends of the sections and also discloses the method of assembling the sections.

The assembly disclosed in the cited document differs from the present invention in the way that the male element and the female element are both present in the same section, while in the present invention the male element and female element are in different sections. The method to assembly the sections also differs from the method disclosed in the present invention.

Other existing solutions, which are also mentioned in several documents, involve the placement of a support structure immediately above the floor, being the modules made to fit in this structure. Refer to the WO2010079462 document featuring a "Modular floor system" and US2009249732 document that mentions a "modular floor system".

BENEFITS OF THE INVENTION

However, all methods described above have the disadvantage that, in order to implement the above stated solutions the modules will have to be manufactured with embedded locking systems, which makes the solutions costlier.

The main advantage of the solution presented in this invention is to provide a solution that can be adapted to any existing floor type, since the connection between modules is achieved by fitting two elements, a male and a female element, which are not embedded in the modules, and that are coupled to them being fixed by a fastener system.

BRIEF DESCRIPTION OF THE DRAWINGS

These and other features are to be easily understood by the accompanying drawings, which should be taken as examples only and are not to be considered as limiting of its scope. For illustrative purposes some of the measurements of the elements of drawings may be exaggerated and not drawn to scale. The absolute and relative dimensions do not match actual relations for carrying out the invention.

Figure 1:
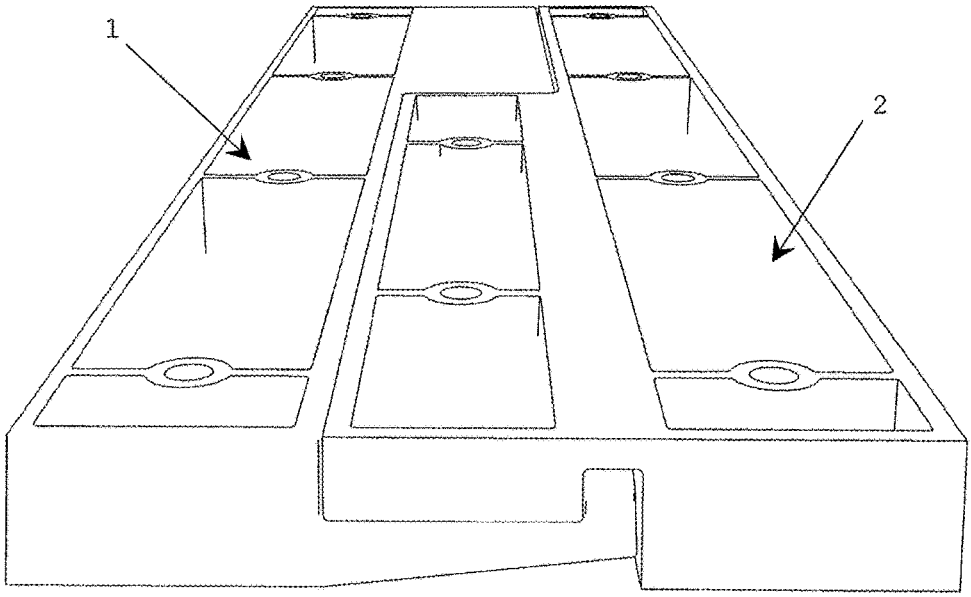
FIG. 1 shows a top view of the fitting between the female (1) and the male (2) elements for connection between floor modules.
Figure 2:
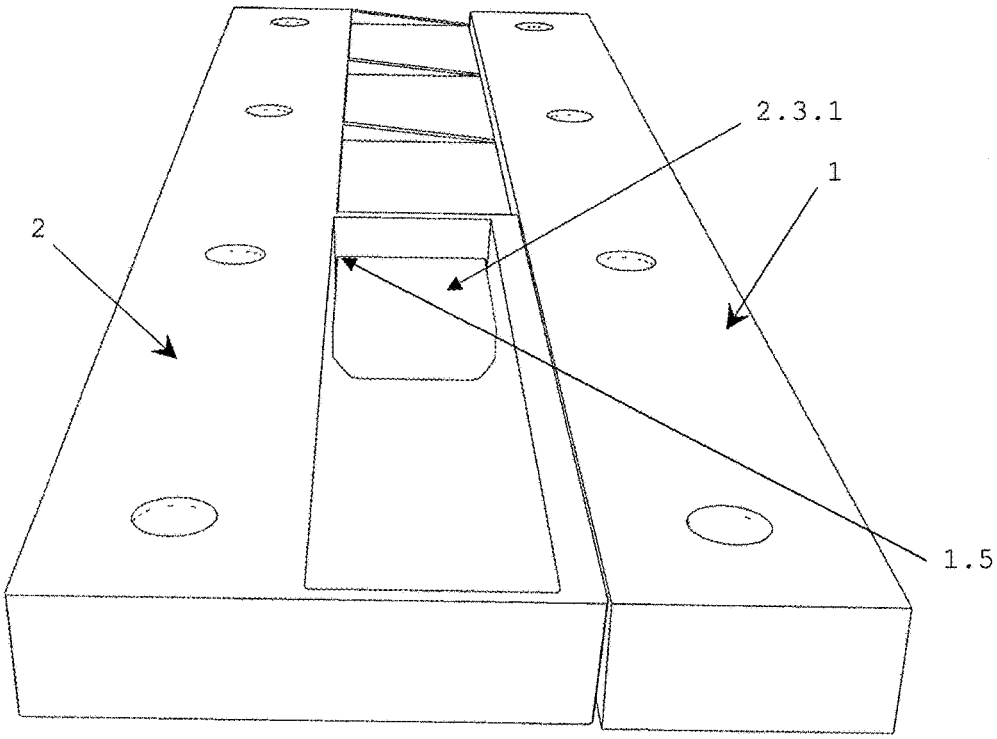
FIG. 2 shows a bottom view of the fitting between the female (1) and the male (2) elements for connection between floor modules, where it can be seen that the latch (2.3.1) of the male element (2) fits in the groove (1.5) of the female element (1).
Figure 3:
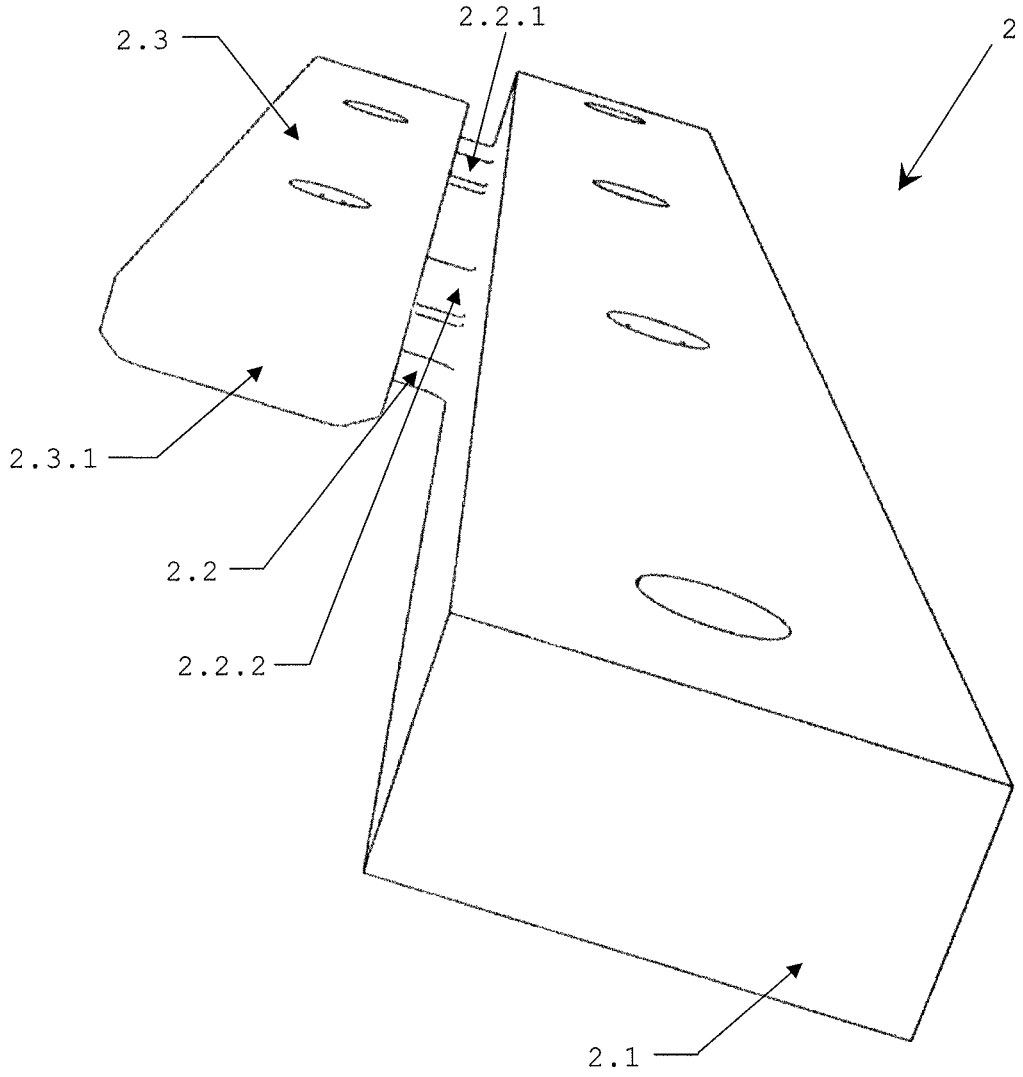
FIG. 3 shows a top front view of the male element (2) for connection between floor modules.
Figure 4:
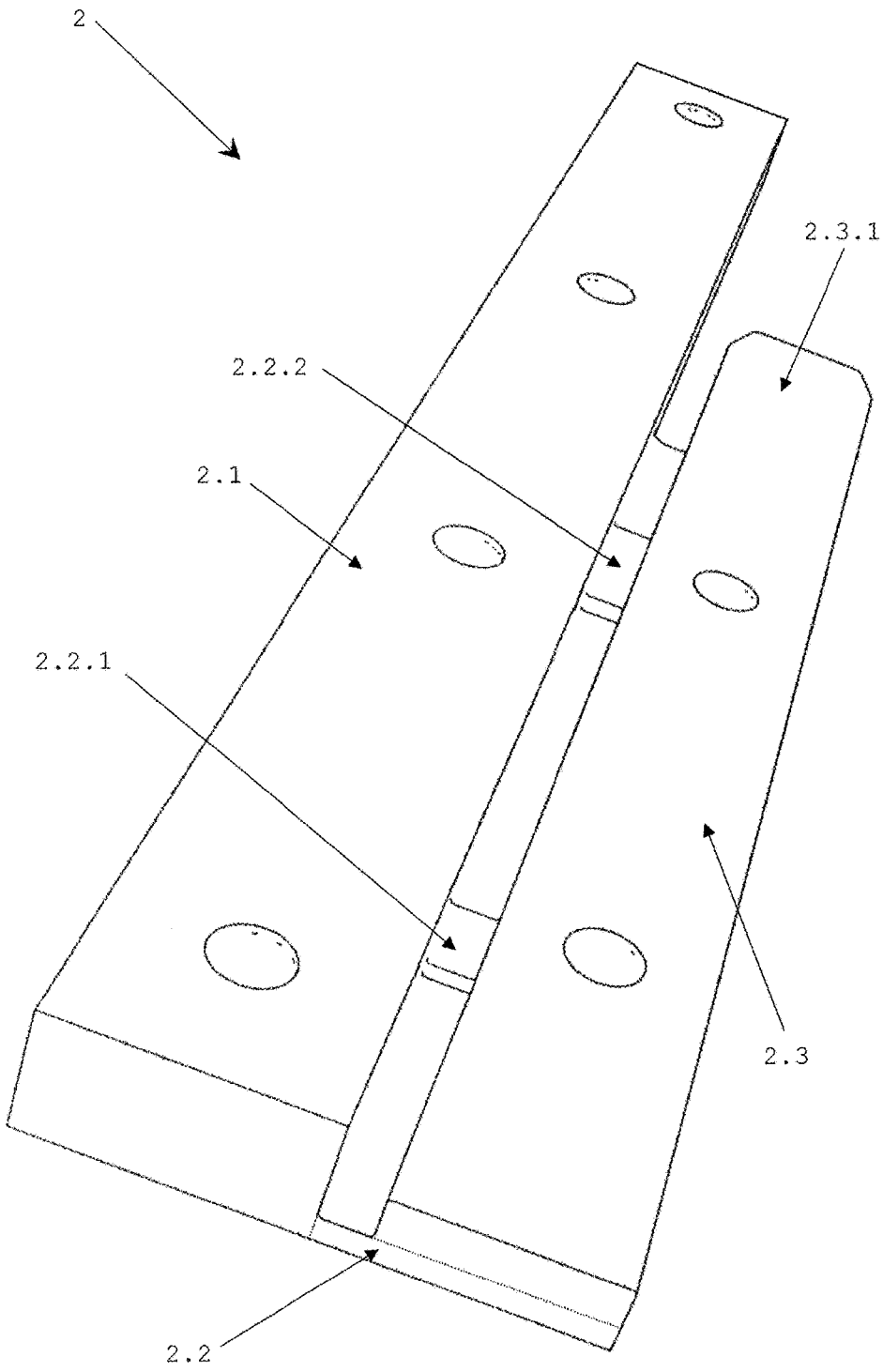
FIG. 4 shows a top rear view of the male element (2) for connection between floor modules.
Figure 5:
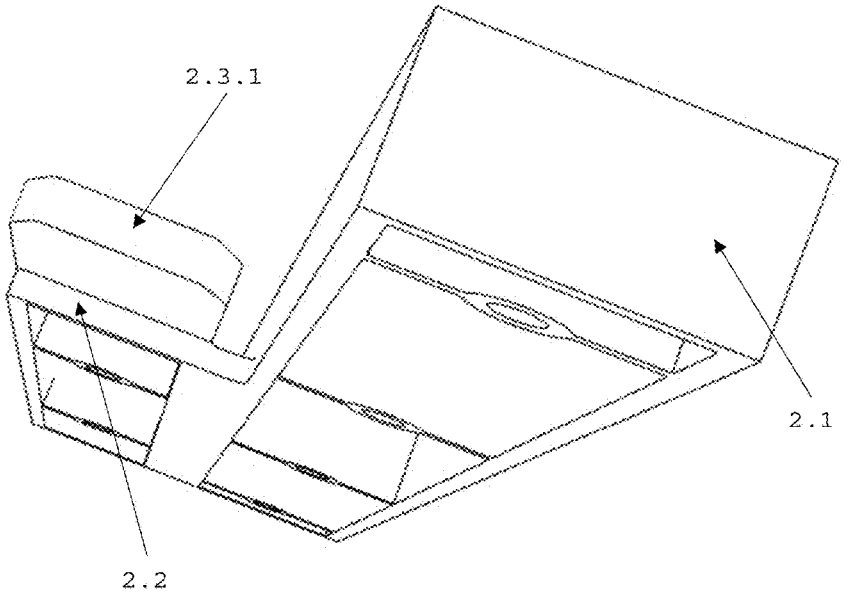
FIG. 5 shows a bottom front view of the male element (2) for connection between floor modules.
Figure 6:
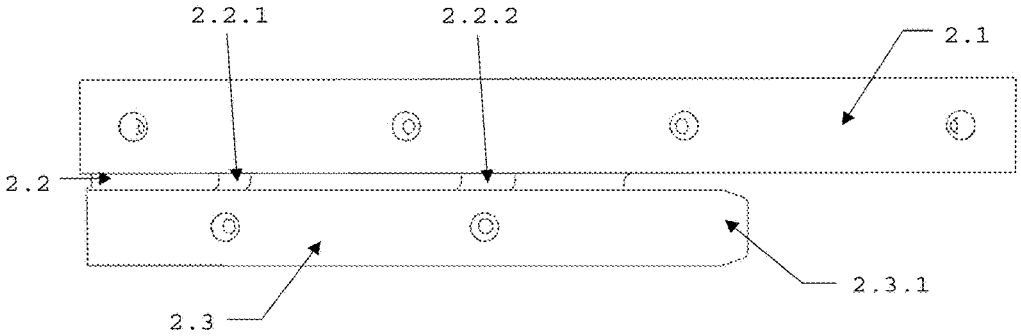
FIG. 6 shows a top view of the male element (2) for connection between floor modules.
Figure 7:
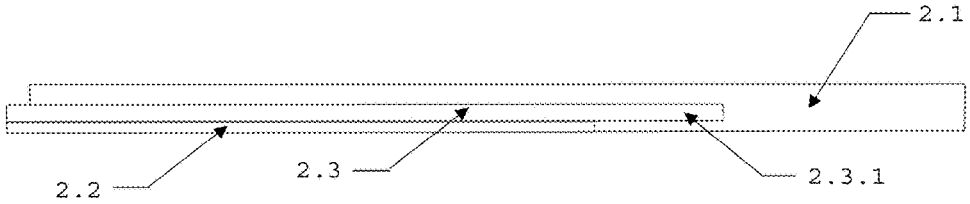
FIG. 7 shows a side view of the male element (2) for connection between floor modules.
Figure 8:
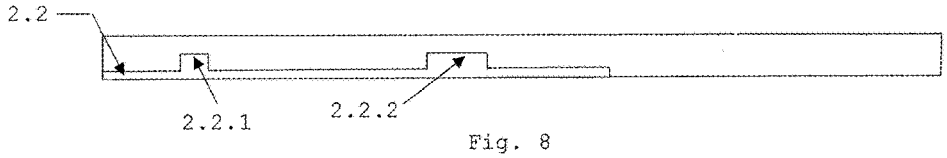
FIG. 8 shows a side view of the male element (2) for connection between floor modules, in which protrusions (2.2.1) (2.2.2) are visible.

Their various components are visible in the figures: female element (1), major plate of the female element (1.1), track (1.2), edge (1.3), notch (1.3.1), notch (1.3.2), superior plate of the female element (1.4), groove (1.5), male element (2), major plate of the male element (2.1), inferior plate (2.2), protrusion (2.2.1), protrusion (2.2.2), minor plate of the male element (2.3) and latch (2.3.1).

DETAILED DESCRIPTION OF THE INVENTION

Expressions such as: "substantially parallelepiped", "substantially cylindrical", "substantially rectangular trapezoidal" shall be construed as preferred embodiments for carrying out the invention since it can operate with other embodiments. By "substantially horizontal", "substantially vertical", "substantially coplanar", "substantially parallel", "substantially equidistant", "substantially aligned" shall be construed as preferred positions for carrying out the invention since it can operate with other positions.

Such terms as "sidewall", "lower surface", "upper surface", "adjacent", "inverted", "end in the longitudinal direction," "opposite end" used in the description are intended only for descriptive purposes and are not intended necessarily for describing relative positions. It is to be noted that the terms are used interchangeably in appropriate circumstances and that the embodiments of the invention described herein are capable of working in other orientations other than those herein described or illustrated. The terms "sidewall", "lower surface", "upper surface", are the positions perceived by an observer facing the modules which make part the present disclosure.

The present disclosure relates to a connection system and a method for fitting together modules that make up the flooring covering.

This system is composed of a female element (1) and a male element (2) connected to the floor modules, and which are interlocked between each other.

The female element (1) and the male element (2) are manufactured in any suitable material for this purpose, particularly polyamide or any other polymeric based material. These materials are characterized by high resistance to stress, which is essential to the proper functioning of the system, which ensures the durability thereof.

In order to better understand the apparatus of this invention, in an embodiment thereof, FIGS. 3, 4, 5, 6, 7 and 8 are reversed, i.e., the upper surface is the one that comes in contact with the ground.

According to FIGS. 3, 4, 5, 6, 7 and 8 the male element (2) comprises:

- major plate of the male element (2.1)
- that presents
  - a substantially parallelepiped shape,
  - a length between 0.01 m and 1 m, more specifically between 0.1 m and 0.5 m, more specifically 0.3 m,
  - a width of between 0.005 m and 0.25 m, more specifically 0.01 m and 0.05 m, more specifically 0.03 m,
  - a height of between 0.001 m and 0.25 m, more specifically from 0.005 m and 0.05 m, more specifically 0.015 m;
- an inferior plate (2.2)
- wherein
  - one of the side walls in the longitudinal direction merges with one of the side walls in the longitudinal direction of the major plate of the male element (2.1),
  - the side wall in the longitudinal direction opposite the side wall in the longitudinal direction merges with the major plate of the male element (2.1), being substantially vertically coplanar and which merges with one of the side walls in the longitudinal direction of the minor plate of the male element (2.3),
- being
  - the wall at one of the ends in the longitudinal direction substantially vertically coplanar and that merges with the wall at one of the ends in the longitudinal direction of the minor plate of the male element (2.3),
  - the upper surface substantially horizontally coplanar with the upper surface of the major plate of the male element (2.1),
- and having
  - a substantially parallelepiped shape,
  - a length between 0.01 m and 1 m, more specifically between 0.05 m and 0.5 m, more specifically 0.1758 m,
  - a width of between 0.005 m and 0.25 m, more specifically 0.01 m and 0.1 m, more specifically 0.03 m,
  - a height of between 0.0001 m and 0.1 m, more specifically between 0.0005 m and 0.05 m, more specifically 0.005 m,
  - two protrusions (2.2.1) (2.2.2) for fitting the notches (1.3.1) (1.3.2) of the edge (1.3) of the female element (1);
- a minor plate of the male element (2.3)
- being
  - one of the walls at the ends in the longitudinal direction substantially vertically coplanar and that merges with the inferior plate (2.2) having the corners cut at the opposite end,
  - one of the side walls in the longitudinal direction substantially coplanar and which merges laterally with the inferior plate (2.2),
- that presents
  - a substantially parallelepiped shape,
  - a length between 0.01 m and 1 m, more specifically between 0.05 m and 0.5 m, more specifically 0.2158 m,
  - a width of between 0.005 m and 0.5 m, more specifically between 0.01 m and 0.1 m, more specifically 0.0243 m,
  - a height of between 0.0001 m and 0.1 m, more specifically between 0.0005 m and 0.05 m, more particularly 0.0067 m,
- and which includes
  - a latch (2.3.1) that fits in the groove (1.5) of the female element (1)
    - which begins on the vertical plane passing through the vertical wall of the end in the longitudinal direction of the inferior plate (2.2) opposite the vertical wall of the end in the longitudinal direction that merges with the major plate of the male element (2.1),
  - and having
    - a length between 0.005 m and 0.2 m, more specifically 0.01 m and 0.1 m, more specifically 0.04 m,
    - a width of between 0.005 m and 0.5 m, more specifically between 0.01 m and 0.1 m, more specifically 0.0243 m,
    - a height of between 0.0001 m and 0.1 m, more specifically between 0.0005 m and 0.05 m, more specifically 0.0067 m.

The major plate of the male element (2.1) and the minor plate of the male element (2.3) have substantially equidistant holes between each other with a substantially cylindrical shape for placing the fastener elements at the lower surface of the floor modules.

Figure 9:
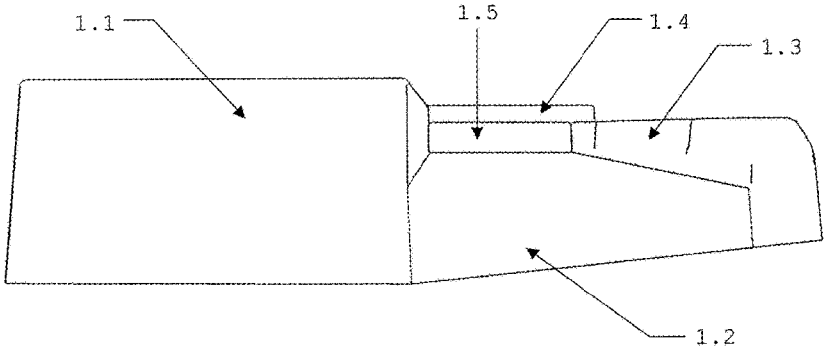
FIG. 9 shows a front view of the female element (1) for connection between floor modules.
Figure 10:
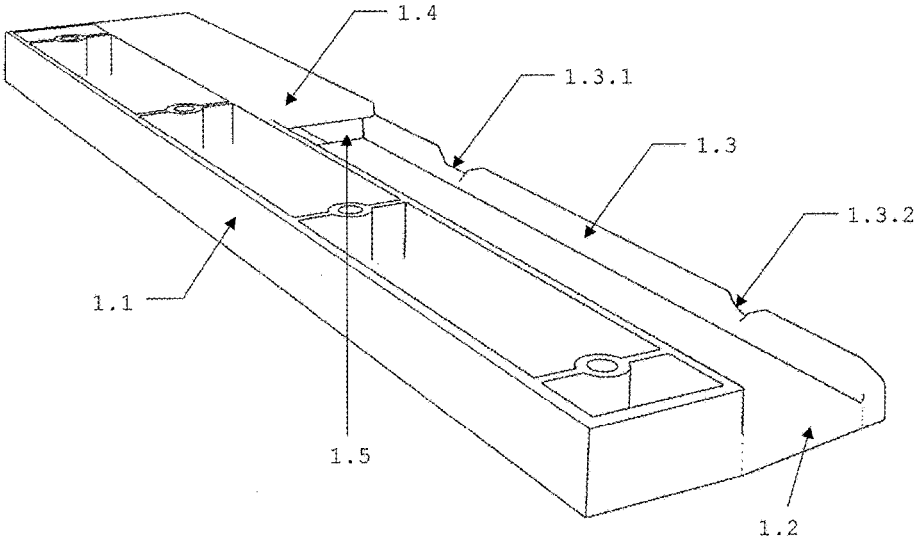
FIG. 10 shows a top front view of the female element (1) for connection between floor modules.
Figure 11:
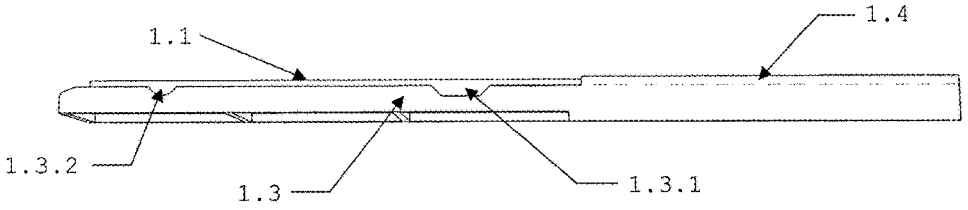
FIG. 11 shows a side view of the female element (1) for connection between floor modules.

According to FIGS. 9, 10 and 11 the female element (1) comprises:

- a major plate of the female element (1.1)
- that presents
  - a substantially parallelepiped shape,
  - a length between 0.01 m and 1 m, more particularly 0.05 m and 0.5 m, more specifically 0.3 m, a width of between 0.005 m and 0.5 m, more specifically between 0.01 m and 0.1 m, more specifically 0.03 m, a height of between 0.005 m and 0.5 m, more specifically between 0.01 m and 0.1 m, more specifically 0.015 m;

a track (1.2)

demarcated on one of the lateral ends by the major plate of the female element (1.1) and on the opposite lateral end by the edge (1.3), and having a substantially rectangular trapezoidal shape, with a substantially horizontal upper surface, a length between 0.05 m and 1.5 m, more specifically between 0.1 m and 0.5 m, more specifically 0.175 m, a width of between 0.005 m and 0.25 m, more specifically between 0.01 m and 0.075 m, more specifically 0.02 m, a height of between 0.001 m and 0.1 m, more specifically between 0.003 m and 0.01 m, more specifically 0.0063 m on the edge adjacent to the major plate of the female element (1.1), a height of between 0.0005 m and 0.1 m, more specifically between 0.001 m and 0.01 m, more specifically 0.0035 m on the adjacent border to the edge (1.3), an edge (1.3)

that presents a length between 0.05 m and 1 m, more specifically between 0.1 m and 0.5 m, more specifically 0.175 m, a width of between 0.001 m and 0.25 m, more specifically between 0.001 m and 0.1 m, more specifically 0.005 m, a height of between 0.001 m and 0.1 m, more specifically between 0.005 m and 0.02 m, more specifically 0.0085 m, two notches (1.3.1) (1.3.2) to be fitted in the protrusions (2.2.1) (2.2.2) of the male element (2);

superior plate of the female element (1.4)

substantially coplanar and which merges with the major plate of the female element (1.1), hollow in its inside, no bottom wall and having a groove (1.5) on the wall at the end in the longitudinal direction merging with the track (1.2) to fit the latch (2.3.1) of the male element (2), and having a substantially parallelepiped shape, a length between 0.05 m and 1 m, more specifically between 0.1 m and 0.5 m, more specifically 0.125 m, a width of between 0.005 m and 0.25 m, more specifically between 0.01 m and 0.075 m, more specifically 0.025 m, a height of between 0.0005 m and 0.05 m, more specifically between 0.001 m and 0.01 m, more specifically 0.003 m.

The major plate of the female element (1.1) exhibits substantially equidistant holes between each other with a substantially cylindrical shape for placing of the fastener elements to the lower surface of the floor modules.

Method of Fitting Male and Female Elements

Figure 12:
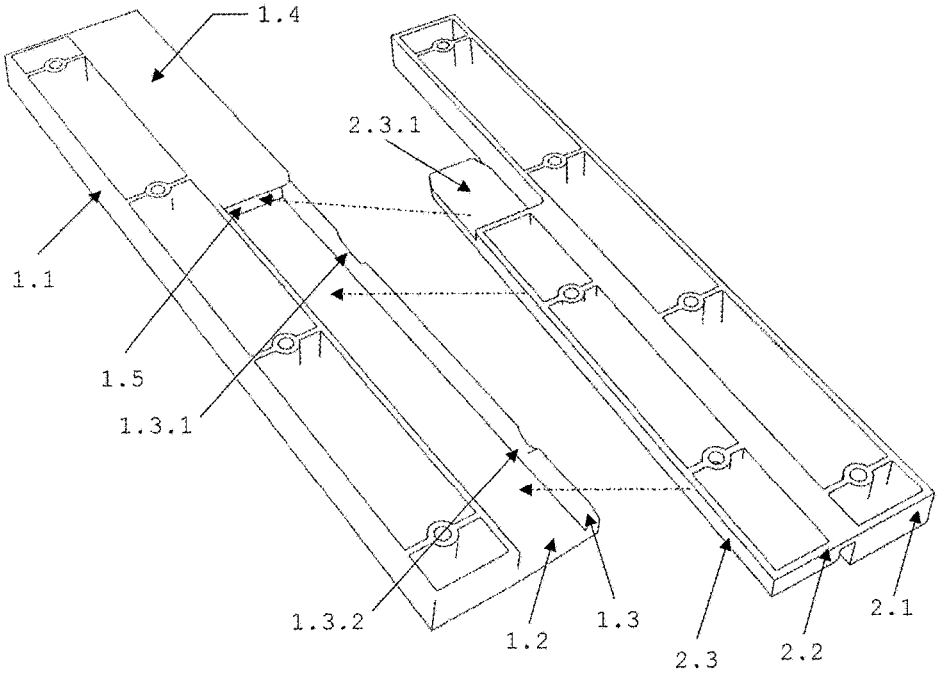
FIG. 12 shows a top view of the locking method of the male element (2) into the female element (1).
Figure 13:
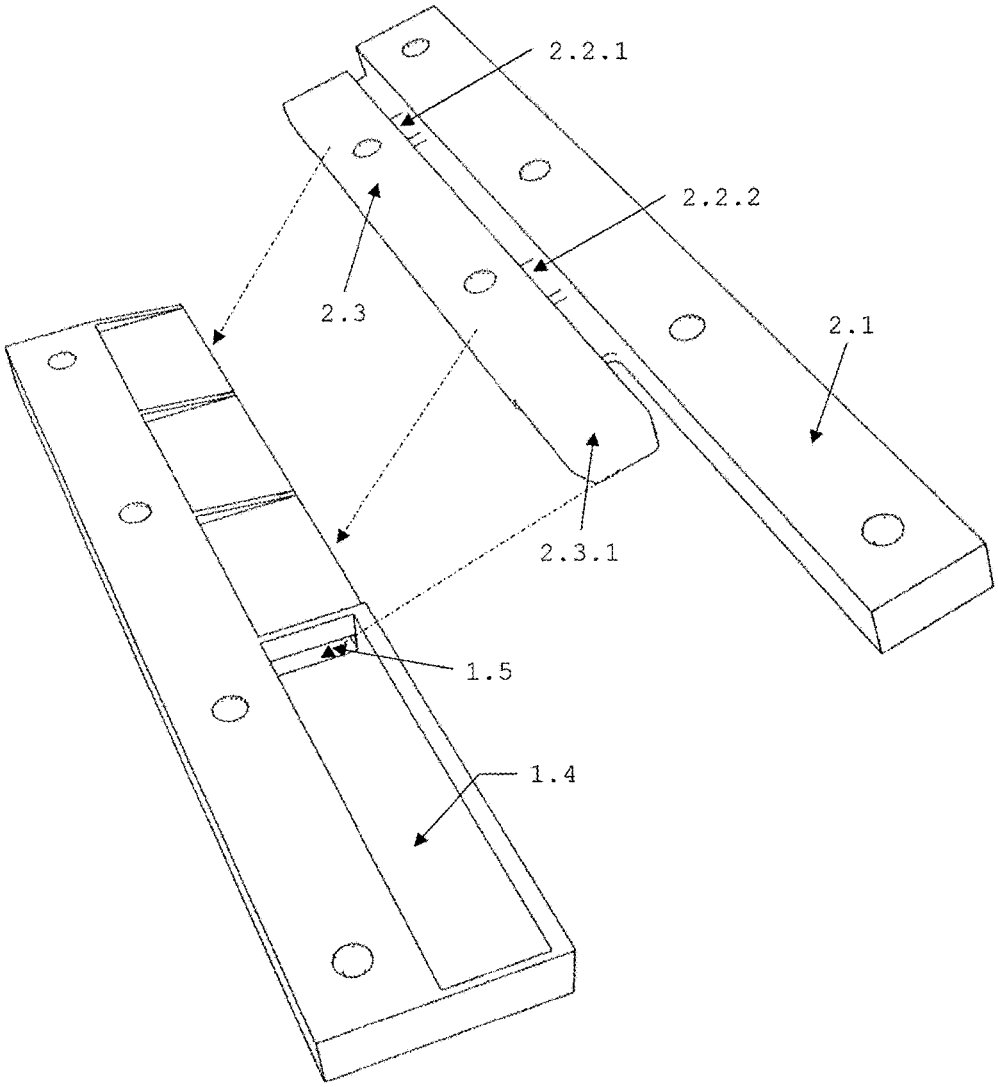
FIG. 13 shows a bottom view of the locking method of the male member (2) into the female element (1).

According to FIGS. 12 and 13, in order to couple the female element (1) with the male element (2), the female element (1) and the male element (2) shall have to be positioned in substantially parallel planes, and the minor plate of the male element (2.3) substantially aligned with the track (1.2).

Then the male element (2) must be displaced so that the minor plate of the male element (2.3) gets in touch with the track (1.2), being the latch (2.3.1) substantially coplanar with groove (1.5). Simultaneously, the edge (1.3) should fit in the space between the side wall of the inferior plate (2.2) and the side wall of the major plate of the male element (2.1).

The male element (2) must be pushed until the latch (2.3.1) enters the groove (1.5), this movement should continue until the latch (2.3.1) is completely under the superior plate of the female element (1.4). This fact occurs when the vertical wall of the superior plate of the female element (1.4) immediately above the groove (1.5) comes into contact with the vertical wall of the inferior plate (2.2) closest to the latch (2.3.1). At this time, the protrusion (2.2.1) of the inferior plate (2.2) will sit and fit in the notch (1.3.2) of the edge (1.3) and the protrusion (2.2.2) of the inferior plate (2.2) will sit and fit in the notch (1.3.1) of the edge (1.3).

The invention claimed is:

1. The system for connection of modules comprising a floor covering composed of a female element and a male element, the system for connection of modules comprising a floor covering having a longitudinal direction and a lateral direction perpendicular to the longitudinal direction, wherein:

the female element comprises:

a major plate having a parallelepiped shape;

a superior plate substantially coplanar with and merging with the major plate and having a parallelepiped shape, a hollow interior and being without a bottom wall, the superior plate comprising:

an end wall at a longitudinal end of the superior plate having a groove, the groove receiving a latch of the male element; and a track having a substantially rectangular trapezoidal shape with a substantially horizontal upper surface, the track comprising:

a first lateral end demarcated by the major plate of the female element;

an edge opposite the first lateral end, the edge comprising notches;

a horizontal upper surface extending between the first lateral end and the edge; and the male element comprising:

a major plate of the male element having a parallelepiped shape and comprising a first and a second side wall extending in a longitudinal direction and an upper surface extending between the first and second side walls;

a minor plate having a parallelepiped shape and comprising:

a first and a second side wall extending in a longitudinal direction;

a first end wall located at a longitudinal end of the minor plate and a second end wall located at a longitudinal end of the minor plate opposite the first end wall, wherein the second end has cut corners;

an upper surface extending between the first and second side walls; and a latch configured for fitting in the groove of the female element, wherein the latch extends at a vertical plane of the minor plate passing through a vertical end wall in the longitudinal direction of an inferior plate opposite a vertical end wall in the longitudinal direction merging with the major plate of the male element;

the inferior plate having a notched parallelepiped shape and comprising:

a first and a second side walls extending in the longitudinal direction;

a first end wall located at a longitudinal end of the inferior plate; and protrusions configured for fitting in the notches of the edge of the female element;

wherein, the first side wall of the inferior plate merges with the major plate of the male element and the second side wall of the inferior plate is substantially coplanar with and merges with the first sidewall of the minor plate, the upper surface of the inferior plate and the upper surface of the major plate of the male element being substantially horizontally coplanar, the first end wall of the inferior plate is substantially vertical coplanar with and merges with the first end wall of the minor plate of the male element, the first sidewall of the minor plate being substantially coplanar and merging laterally with the inferior plate, and the first side wall of the minor plate merging laterally with the first end wall of the minor plate, the notches are configured for fitting the protrusions, and the male element being configured to connect to the female element by longitudinally sliding the first longitudinal edge of the minor plate of the male element along the major plate of the female element with the latch passing into the groove and the notches receiving the protrusions.

2. The system for connection of modules comprising a floor covering according to claim 1, wherein the female element and the male element belong to separate plates.

3. The system for connection of modules comprising a floor covering according to claim 1, wherein the major plate of the female element has a plurality of holes located substantially equidistant from one another, the holes configured for placement of fasteners to a lower surface of the floor modules.

4. The system for connection of modules comprising a floor covering according to claim 1, wherein the major plate of the male element and the minor plate of the male element have a plurality of holes located substantially equidistant from one another, configured for placement of fasteners to a lower surface of the floor modules.

5. The system for connection of modules comprising a floor covering according to claim 1, wherein the female element and the male element are connected to the floor modules, and interconnected with each other.

6. The system for connection of modules comprising a floor covering according to claim 1, wherein the female element and the male element are manufactured from a polymeric based material.

7. The system for connection of modules comprising a floor covering according to the claim 6, wherein the polymeric based material is polyamide.

8. A method of assembling the female element and the male element of the system for connecting the modules that comprise the floor covering claimed in claim 1, comprising the following steps:

the female element and the male element are positioned in substantially parallel planes, and the minor plate of the male element is substantially aligned with the track;

the male element is displaced so that the minor plate of the male element contacts the track, the latch being substantially coplanar with groove; simultaneously, the edge will fit in the space between the side wall of the inferior plate and the side wall of the major plate of the male element;

the male element is pushed and slides through the track until the latch fits in the groove, this movement should continue until the latch is completely under the superior plate of the female element, this fact occurring when the vertical wall of the superior plate of the female element immediately above the groove comes into contact with the vertical wall of the inferior plate closest to the latch; at this point the protrusion of the inferior plate rests on, and is coupled to, the notch of the edge and the protrusion of the inferior plate rests and couples with notch of the edge;

wherein the notches fitting the protrusions of the male element.

* * * * *